US008870354B2

(12) United States Patent
Togashi

(10) Patent No.: US 8,870,354 B2
(45) Date of Patent: Oct. 28, 2014

(54) FLOW PATH MEMBER, LIQUID EJECTION HEAD, LIQUID EJECTION APPARATUS AND LIQUID STORING UNIT

(71) Applicant: Seiko Epson Corporation, Tokyo (JP)

(72) Inventor: Isamu Togashi, Matsumoto (JP)

(73) Assignee: Seiko Epson Corporation (JP)

( * ) Notice: Subject to any disclaimer, the term of this patent is extended or adjusted under 35 U.S.C. 154(b) by 0 days.

(21) Appl. No.: 13/926,131

(22) Filed: Jun. 25, 2013

(65) Prior Publication Data

US 2014/0009537 A1 Jan. 9, 2014

(30) Foreign Application Priority Data

Jul. 4, 2012 (JP) ..... 2012-150821

(51) Int. Cl.
*B41J 2/175* (2006.01)
*B41J 2/14* (2006.01)
*B41J 2/145* (2006.01)

(52) U.S. Cl.
CPC ..... *B41J 2/145* (2013.01); *B41J 2/1752* (2013.01); *B41J 2/17553* (2013.01); *B41J 2/17513* (2013.01)
USPC ..... 347/85; 347/49

(58) Field of Classification Search
USPC ..... 347/7, 49, 84–85, 92–93
See application file for complete search history.

(56) References Cited

U.S. PATENT DOCUMENTS 5,699,095 A * 12/1997 Mitsuzawa et al. ..... 347/92
6,033,062 A * 3/2000 Hotomi ..... 347/86
6,050,681 A * 4/2000 Yamashita et al. ..... 347/86
6,976,754 B2 * 12/2005 Ohashi et al. ..... 347/92
8,205,974 B2 * 6/2012 Ogura et al. ..... 347/86

FOREIGN PATENT DOCUMENTS

JP 2007-15272 1/2007

* cited by examiner

*Primary Examiner* — Anh T.N. Vo
(74) *Attorney, Agent, or Firm* — Harness, Dickey & Pierce, P.L.C.

(57) ABSTRACT

A flow path forming body that includes a liquid supply path, and a mounting section; a filter that is fixedly attached to the mounting section so as to cover an opening of the liquid supply path; and a seal member disposed on a circumference of the mounting section and made of an elastic material are provided, wherein a buffer chamber is provided in the liquid supply path downstream of the filter, and an air bubble discharge section having a wall is provided in a region at least distant from the opening of the liquid supply path downstream of the buffer chamber in a plane direction of the filter such that the wall is closer to the filter than to the buffer chamber and has a width in the plane direction of the filter which is larger than that of the buffer chamber.

13 Claims, 5 Drawing Sheets

FLOW PATH MEMBER, LIQUID EJECTION HEAD, LIQUID EJECTION APPARATUS AND LIQUID STORING UNIT

BACKGROUND

1. Technical Field

The present invention relates to a flow path member that supplies liquid to a head body which ejects liquid through nozzle openings, a liquid ejection head that includes the flow path member, a liquid ejection apparatus that includes the liquid ejection head, and a liquid storing unit that is loaded onto the flow path member.

2. Related Art

An ink jet recording head that ejects ink droplets is a typical example of liquid ejection head that ejects liquid droplets. JP-A-2007-15272 discloses an ink jet recording head that includes, for example, a head body which ejects ink droplets through nozzle openings, and a flow path member to which the head body is fixedly attached and on which ink cartridges (liquid storing units) for storing ink are detachably mounted so that ink is supplied from the ink cartridges to the head body.

According to JP-A-2007-15272, a supply section formed by a press contact body made of a porous material is provided in the ink cartridge. When the supply section comes into pressing contact with a filter which is disposed on a flow path member, and a seal member seals a circumference of the press contact body and the filter, the ink cartridges are connected to the flow path member.

However, when the ink cartridges are removed from the flow path member, water contained in ink in the flow path is evaporated through the filter since the filter is exposed. Particularly, when pigment ink is used, there is a problem that ink thickens and turns into a gel or is deposited.

Such a problem is not limited to the flow path member used for the ink jet recording head, but also exists in any flow path member used for a liquid ejection head that ejects liquid other than ink.

SUMMARY

An advantage of some aspects of the invention is that a flow path member, a liquid ejection head and a liquid ejection apparatus are provided which are capable of preventing liquid remaining downstream of the filter from thickening in a short period of time even if water evaporates through the filter, and improving the ability to discharge air bubbles.

According to an aspect of the invention, a flow path member includes a flow path forming body that includes a liquid supply path through which liquid is supplied to a head body that ejects the liquid, and a mounting section to which one end of the liquid supply path is open and on which a liquid storing unit that supplies liquid to the liquid supply path is mounted; a filter that is fixedly attached to the mounting section so as to cover an opening of the liquid supply path; and a seal member disposed on a circumference of the mounting section and made of an elastic material, wherein a buffer chamber is provided in the liquid supply path downstream of the filter, and an air bubble discharge section having a wall is provided in a region at least distant from the opening of the liquid supply path downstream of the buffer chamber in a plane direction of the filter such that the wall is closer to the filter than to the buffer chamber and has a width in the plane direction of the filter which is larger than that of the buffer chamber. With this configuration, by providing the buffer chamber, it is possible to prevent ink remaining downstream of the filter from thickening in a short period of time due to evaporation of water through filter, thereby preventing ink from turning into a gel or from being deposited. Although the ability to discharge air bubbles are reduced by providing the buffer chamber, the flow speed of liquid which flows through the air bubble discharge section can be increased by providing the air bubble discharge section, thereby improving the ability to discharge air bubbles.

The air bubble discharge section is preferably continuously formed in the circumferential direction of the buffer chamber. With this configuration, an area in which air bubbles tend to accumulate can be decreased compared with the case in which the air bubble discharge section is discontinuously formed.

The wall that defines the air bubble discharge section is preferably disposed at a constant distance from the filter in a direction perpendicular to the plane direction of the filter. With this configuration, the amount of liquid remaining downstream of the filter can be increased, thereby preventing liquid from thickening in a short period of time due to evaporation of water.

According to another aspect of the invention, a liquid ejection head includes the flow path member according to the above aspect of the invention and a head body. With this configuration, it is possible to achieve the liquid ejection head that prevents ejection failure due to thickening of liquid in a short period of time.

Further, according to another aspect of the invention, a liquid ejection apparatus includes the liquid ejection head according to the above aspect. With this configuration, it is possible to achieve the liquid ejection head that prevents ejection failure due to thickening of liquid in a short period of time.

BRIEF DESCRIPTION OF THE DRAWINGS

The invention will be described with reference to the accompanying drawings, wherein like numbers reference like elements.

DESCRIPTION OF EXEMPLARY EMBODIMENTS

The invention will be described below in detail with reference to embodiments of the invention.

First Embodiment

Figure 1:
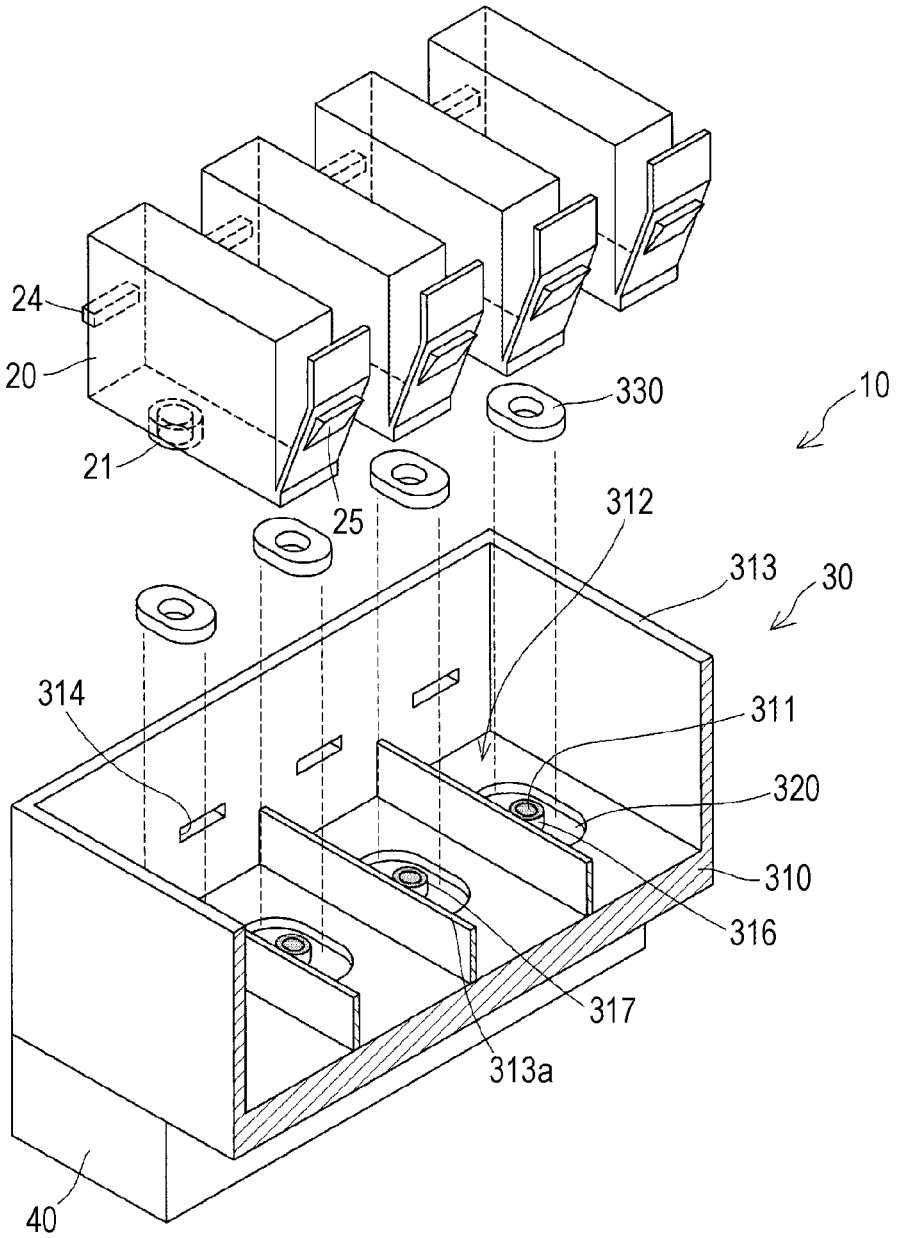
FIG. 1 is an exploded perspective view of a recording head according to a first embodiment.
Figure 2A:
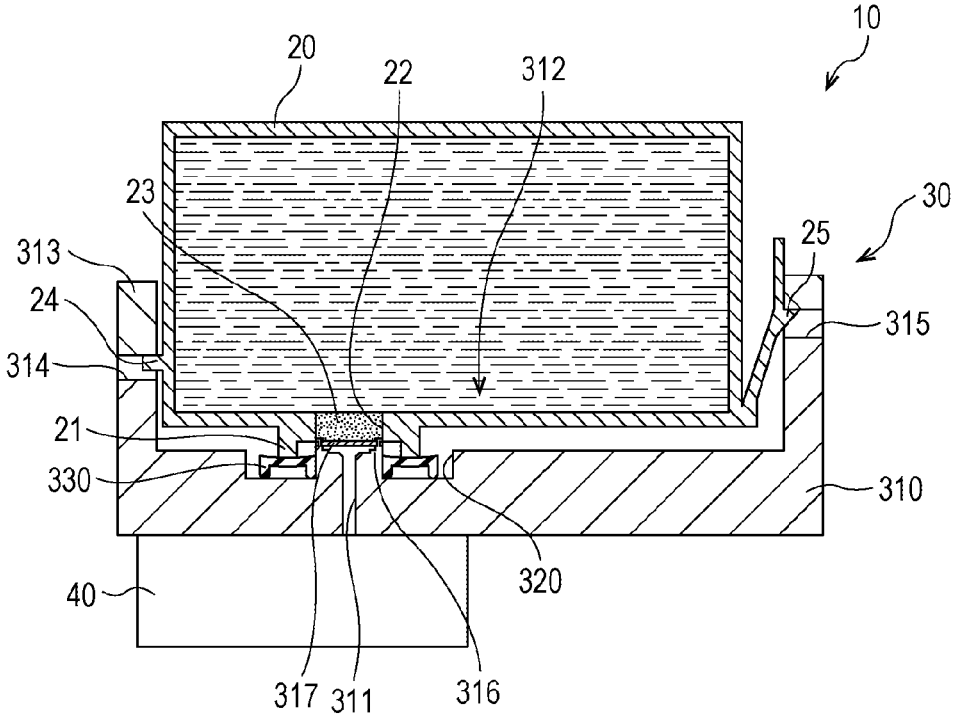
FIG. 2A is a sectional view of the recording head according to the first embodiment.
Figure 2B:
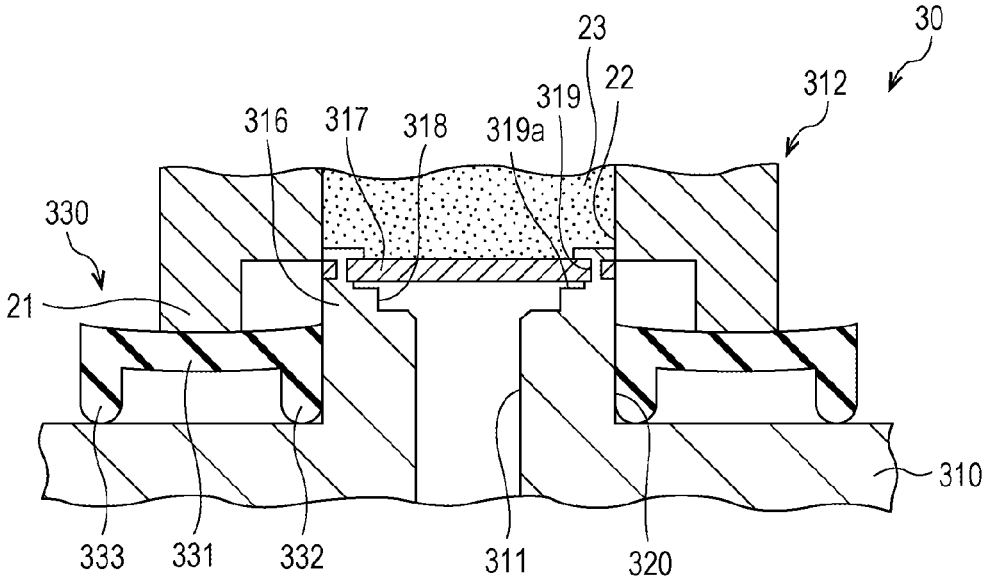
FIG. 2B is an enlarged sectional view of an essential part of the recording head according to the first embodiment.

FIG. 1 is an exploded perspective view of an ink jet recording head which is a liquid ejection head according to a first embodiment of the invention. FIG. 2A is a sectional view of the ink jet recording head and FIG. 2B is an enlarged view of an essential part of the ink jet recording head.

As shown in figures, an ink jet recording head 10 of this embodiment includes a flow path member 30 and a head body 40 that is fixedly attached on the flow path member 30. Ink cartridges 20 which are liquid storing units for storing ink in liquid form are detachably mounted on the flow path member 30.

The flow path member 30 includes a flow path forming body 310 and seal members 330 that are provided on the flow path forming body 310.

In the flow path forming body 310, liquid supply paths 311 are formed so that ink in liquid form flows through the liquid supply paths 311. The ink cartridges 20 are loaded onto a cartridge loading section 312 that is formed on a surface of the flow path forming body 310 to which the liquid supply paths 311 are open. In this embodiment, four ink cartridges 20 are loaded onto the cartridge loading section 312.

The cartridge loading section 312 is surrounded by walls 313. One of a pair of opposing walls 313 has a first engagement hole 314 that penetrates through the thickness of the wall 313, while the other of the pair of opposing walls 313 which opposes the wall 313 on which the first engagement hole 314 is formed has a second engagement hole 315 that penetrates through the thickness of the wall 313.

As will be described later in detail, the first engagement hole 314 and the second engagement hole 315 engage with a first engagement hook 24 and a second engagement hook 25 of the ink cartridge 20, respectively, thereby securing the ink cartridge 20 on the cartridge loading section 312.

In this embodiment, since four ink cartridges 20 are loaded onto the cartridge loading section 312, the cartridge loading section 312 has partition walls 313*a* that separate each of the ink cartridges 20.

Further, mounting sections 316 are formed as cylindrical protrusions on the cartridge loading section 312 of the flow path forming body 310. In this embodiment, four mounting section 316 are provided since four ink cartridges 20 are mounted on the cartridge loading section 312. The liquid supply paths 311 are open to the distal end surfaces of the mounting sections 316 which are in a cylindrical shape. Filters 317 are disposed on the distal end surfaces of the mounting sections 316 so as to cover the liquid supply paths 311.

The filters 317 are provided to filter out foreign matters and air bubbles contained in ink in liquid form. The filters 317 may include, for example, a sheet-shaped filter having a plurality of micro pores formed from finely braided fibers made of a material such as metal and resin, or a plate-shaped filter made of a material such as metal or resin having a plurality of micro pores that penetrate through the filter. Further, the filters 317 may also be formed from nonwoven cloth which is made of any suitable material.

The filters 317 are each formed in a disc shape having a surface area which is substantially the same as that of the distal end surface of the mounting section 316 (the surface to which the liquid supply path 311 is open). The filters 317 are bonded on the distal end surface of the mounting sections 316 by thermal adhesion or adhesive bonding. In this embodiment, the filters 317 are bonded on the distal end surface of the mounting sections 316 by thermal adhesion.

In the liquid supply path 311*a* buffer chamber 318 is provided downstream of the filter 317. The buffer chamber 318 has an opening larger than that of the liquid supply path 311 which is on the side of the head body 40. The buffer chamber 318 has a width (diameter) which is substantially constant in the depth direction (stacking direction of the flow path member 30 and the head body 40) in plan view seen from the side of the filter 317. In this embodiment, the opening of the buffer chamber is formed into a substantially round shape. A bottom of the buffer chamber 318, that is, a wall of the buffer chamber 318 on the side opposite to the filter 317 is disposed at a substantially constant distance from the filter 317 in a plane direction of the filter 317. At the bottom of the buffer chamber 318, the liquid supply path 311 on the downstream side is open. In this embodiment, the liquid supply path 311 on the downstream side is disposed at the center of the filter 317 and the edge of the opening of the liquid supply path 311 is chamfered.

Further, an air bubble discharge section 319 is disposed between the buffer chamber 318 and the filter 317 at a region at least distant from the liquid supply path 311 downstream of the buffer chamber 318. The air bubble discharge section 319 is formed by a wall 319*a* which is located closer to the filter 317 than to the buffer chamber 318. That is, the air bubble discharge section 319 has a width in a plane direction of the filter 317 larger than that of the buffer chamber 318.

In this embodiment, since the buffer chamber 318 has an opening in a substantially round shape, and the liquid supply path 311 on the downstream side is disposed at the center of the buffer chamber 318, the circumferential surface of the buffer chamber 318 extends in the circumferential direction at a substantially constant distance from (the opening of) the liquid supply path 311 on the downstream side. Accordingly, in this embodiment, the air bubble discharge section 319 is continuously formed in the circumferential direction of the buffer chamber 318. The air bubble discharge section 319 is provided for increasing the flow speed of ink which flows through the air bubble discharge section 319 by providing the wall 319*a* so as to form a narrow gap between the wall 319*a* and the filter 317. That is, since the air bubble discharge section 319 is provided at a position distant from the opening of the liquid supply path 311 that is open to the buffer chamber 318 and at a region in which the flow speed increases, the air bubble discharge section 319 serves to improve the ability to discharge air bubbles by increasing the flow speed of ink. Accordingly, in the case where the opening of the buffer chamber 318 is formed in an elliptical shape, the air bubble discharge section 319 may be provided at a position at least most distant from the liquid supply path 311 on the downstream side. For example, the air bubble discharge sections 319 may be disposed at both ends of the elliptical opening of the buffer chamber 318 in the longitudinal direction. Further, in the case where the opening of the liquid supply path 311 that is open to the bottom of the buffer chamber 318 is disposed offset from the center of the buffer chamber 318, the air bubble discharge section 319 may be provided at a position at least most distant from the liquid supply path 311 on the downstream side.

The air bubble discharge section 319 is defined by the wall 319*a* which is located closer to the filter 317 than to the buffer chamber 318. As shown in FIG. 2B, the distance between the filter 317 and the wall 319*a* is a distance in the direction perpendicular to the plane direction of the filter 317. The wall 319*a* which defines the air bubble discharge section 319 is disposed at a substantially constant distance from the filter 317 in a plane direction of the filter 317. This allows the flow speed of ink (liquid) which flows through the air bubble discharge section 319 to increase and allows the volume of the air bubble discharge section 319 to increase as possible, thereby suppressing thickening of ink due to evaporation through the filter 317.

Accordingly, by providing the buffer chamber 318 having a large volume downstream of the filter 317, ink immediately under the filter 317 is prevented from thickening due to evaporation of water through the filter 317, thereby preventing ink from turning into a gel or from being deposited. That is, if the amount of ink remaining downstream of the filter 317 is small, the ink remaining downstream of the filter 317 thickens in a short period of time due to evaporation of water through the filter 317. Particularly, when pigment ink is used, ink thickens and turns into a gel or is deposited in a short period of time. In this embodiment, the buffer chamber 318 which is provided downstream of the filter 317 allows the amount of ink remaining downstream of the filter 317 to increase. As a result, even if water evaporates through the filter 317, the ink remaining downstream of the filter 317 can be prevented from thickening in a short period of time, thereby delaying the time when the ink turns into a gel or ink is deposited.

The buffer chamber 318 is disposed at a substantially constant distance from the filter 317 in a plane direction of the filter 317. Accordingly, although the volume of the buffer chamber 318 can be obtained, the flow speed of ink (liquid) which flows in the region distant from the opening of the liquid supply path 311 at the bottom of the buffer chamber 318 decreases. In this embodiment, the air bubble discharge section 319 is defined by the wall 319*a* that is disposed at a position between the buffer chamber 318 and the filter 317 so as to reduce the distance between the wall 319*a* and the filter 317. Accordingly, the flow speed of the ink (liquid) which flows through the air bubble discharge section 319 increases. This results in the ability to discharge air bubbles to be improved by increasing the flow speed of ink which flows in the region distant from the liquid supply path 311 on the downstream side.

If the configuration does not include the air bubble discharge section 319 and uses the buffer chamber 318 only, the buffer chamber 318 provide a longer distance between the filter 317 and the wall of the buffer chamber 318 which opposes the filter 317 and causes the flow speed of ink which flows in the region distant from the liquid supply path 311 (the opening of the buffer chamber 318) to decrease. In this case, air bubbles passing through the filter 317 accumulate in a region distant from the liquid supply path 311. The accumulated air bubbles grow and may flow into the head body 40 at an unintentional timing, which causes a problem such as dot missing. In this embodiment, by providing the air bubble discharge section 319, air bubbles can be reliably discharged during a cleaning operation or the like. During the cleaning operation, ink is suctioned from nozzle openings (not shown in the figure) of the head body 40 or the like by increasing the flow speed of ink which flows in the air bubble discharge section 319, thereby reducing a problem such as dot missing caused by accumulation of air bubbles.

Further, an annular sealing recess 320 is formed around the mounting section 316 which has the above described filter 317, and a seal member 330 is disposed in the sealing recess 320.

Figure 3A:
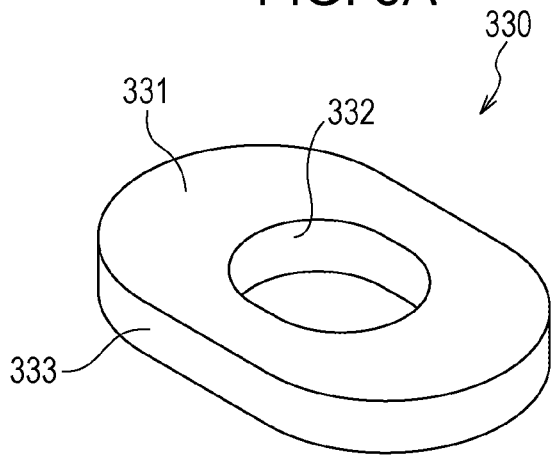
FIGS. 3A and 3B are perspective views of a seal member according to the first embodiment.
Figure 3B:
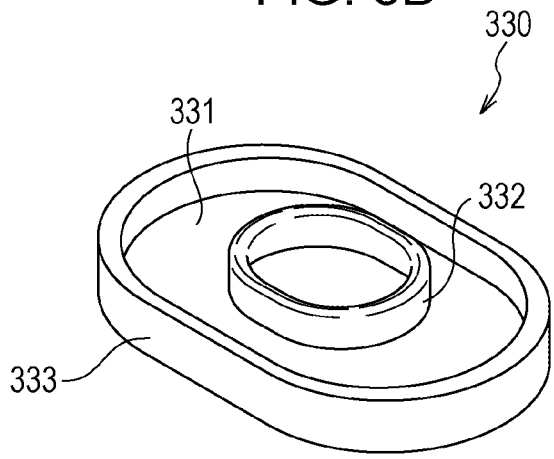

With reference to FIGS. 3A and 3B, the seal member 330 will be described below in detail. FIGS. 3A and 3B are perspective views of the seal member 330.

As shown in FIGS. 3A and 3B, the seal member 330 is formed of a flexible material such as rubber and elastomer, and includes a first seal section 331 in a plate shape, a second seal section 332 in a cylindrical shape, and a third seal section 333 in a cylindrical shape having an inner diameter larger than the second seal section 332.

The second seal section 332 has a cylindrical shape that fits on the outer circumference of the mounting section 316. The third seal section 333 has a cylindrical shape having an inner diameter larger than the second seal section 332. The first seal section 331 is integrally formed with one end of the second seal section 332. Further, the outer periphery of the first seal section 331 is integrally formed with one end of the third seal section 333. That is, the seal member 330 is formed in a C-shape that is open facing to the flow path forming body 310.

In this embodiment, the second seal section 332 has an inner diameter that is sized to be substantially close contact with the outer circumference of the mounting section 316. The third seal section 333 has an outer diameter that is slightly smaller than the sealing recess 320 that is formed around the mounting section 316.

The seal member 330 fits on the outer circumference of mounting section 316. Since the first seal section 331 is supported by an upper end of the second seal section 332 (the end on the side of the ink cartridge 20) and an upper end of the third seal section 333, the first seal section 331 between the second seal section 332 and the third seal section 333 is flexibly deformable to bulge toward the flow path forming body 310 due to pressing force from the ink cartridge 20.

As shown in FIGS. 1 and 2, the ink cartridge 20 that is detachably mounted on the flow path member 30 has a hollow box shape in which ink (liquid) is stored.

A cylindrical rib 21 is disposed on the bottom of the ink cartridge 20, and a supply port 22 is disposed inside the rib 21 so that ink is supplied from the ink cartridge 20 to the flow path member 30. Further, a supply section 23 is disposed inside the supply port 22. The supply section 23 is configured to make pressing contact with the filter 317 of the flow path member 30 and supply ink from the ink cartridge 20 to the liquid supply path 311 of the flow path member 30. Such supply section 23 may be formed of a porous material or nonwoven cloth, for example, cotton-like pulp, superabsorbent polymer, and urethane foam.

The ink cartridge 20 also includes a first engagement hook 24 that is inserted into a first engagement hole 314 formed on the wall 313 of the flow path forming body 310, and a second engagement hook 25 that is disposed on the side opposite to the first engagement hook 24 and is inserted into a second engagement hole 315 formed on the wall 313 of the flow path forming body 310.

The second engagement hook 25 is integrally formed with the ink cartridge 20 with one end being connected to the side face of the ink cartridge 20 on the side of the supply section 23 and the other end being a free end. The second engagement hook 25 is elastically deformable toward the side face of the ink cartridge 20.

Figure 4A:
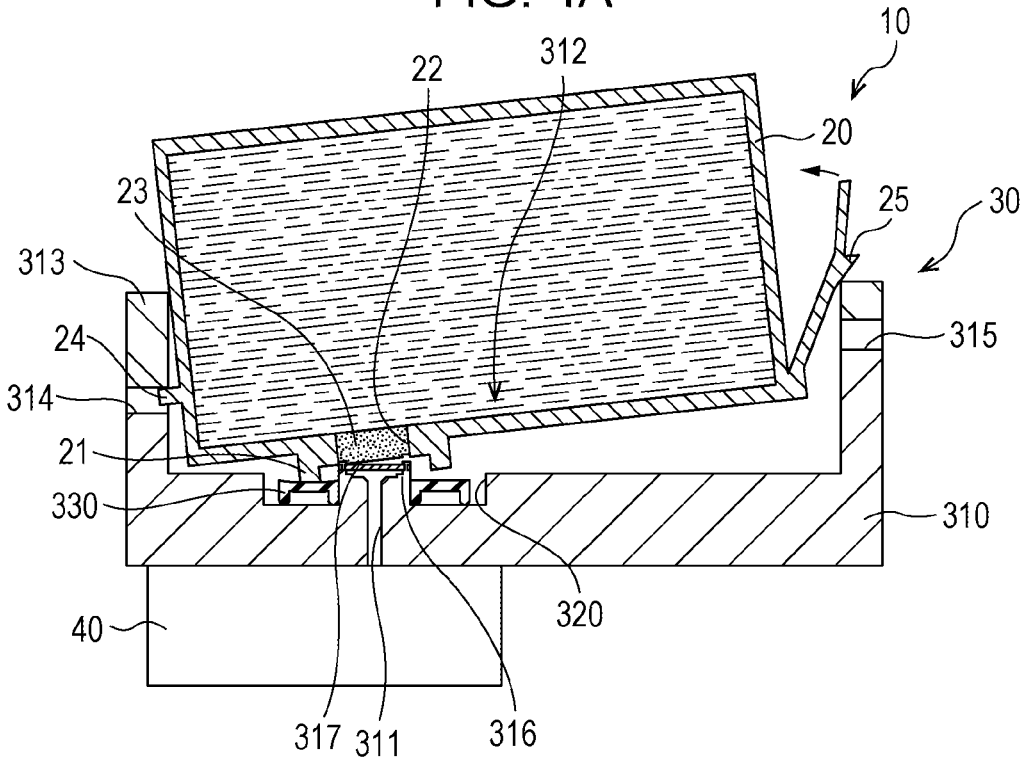
FIGS. 4A and 4B are sectional views which show that an ink cartridge is loaded onto a flow path member according to the first embodiment.
Figure 4B:
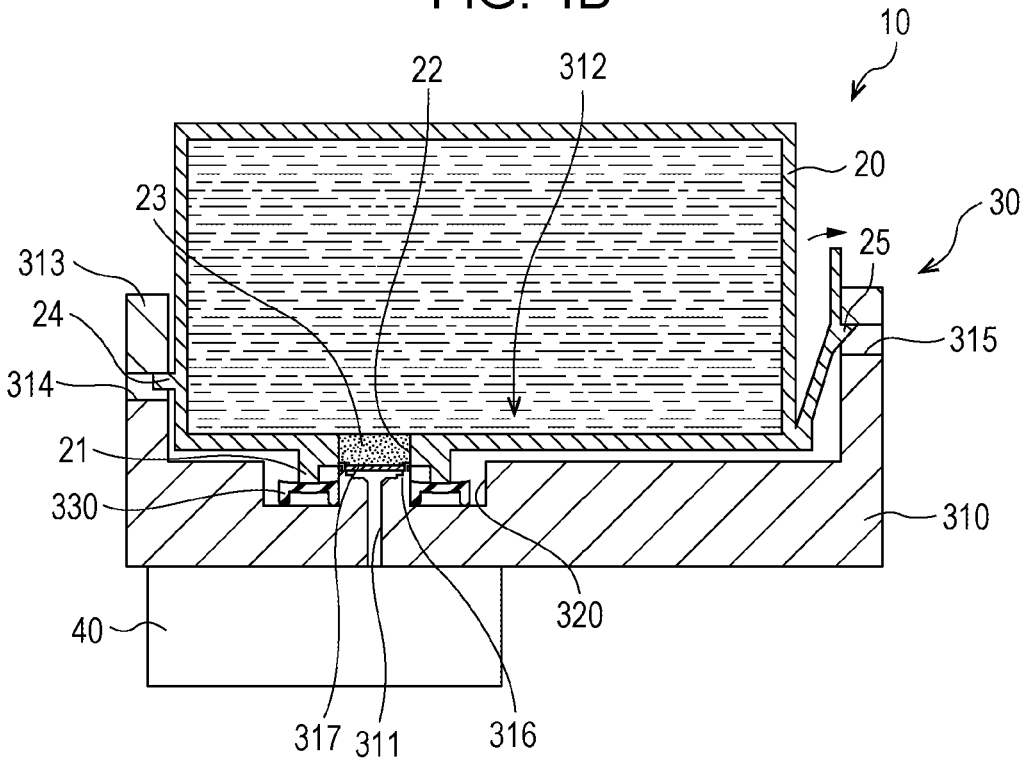

With reference to FIGS. 4A and 4B, loading process of the ink cartridge 20 onto the flow path member 30 will be described in detail. FIGS. 4A and 4B are sectional views which show that the ink cartridge 20 is loaded onto the flow path member according to the first embodiment of the invention.

First, as shown in FIG. 4A, the first engagement hook 24 of the ink cartridge 20 is obliquely inserted into the wall 313 of the flow path forming body 310 so that the first engagement hook 24 is inserted into the first engagement hole 314.

Then, as shown in FIG. 4B, while the first engagement hook 24 of the ink cartridge 20 is inserted into the first engagement hole 314, the ink cartridge 20 is rotated about a pivot point of the first engagement hook 24 so that the ink cartridge 20 is inserted into the wall 313. Since the second engagement hook 25 is pressed by the wall 313 of the flow path forming body 310 and is elastically deformed, the second engagement hook 25 does not interfere with the ink cartridge 20 being inserted into the wall 313. By inserting the second engagement hook 25 of the ink cartridge 20 into the second engagement hole 315, the second engagement hook 25 engages with the second engagement hole 315, and the ink cartridge 20 is loaded onto the cartridge loading section 312. The rib 21 of the ink cartridge 20 abuts against the first seal section 331 of the seal member 330, and accordingly, the first seal section 331 between the second seal section 332 and the third seal section 333 is flexibly deformed and bulges toward the flow path forming body 310, thereby sealing the inside of the rib 21 (see FIG. 2B).

The head body 40 is fixedly provided on the flow path member 30 on the side opposite to the cartridge loading section 312.

The head body 40 has a liquid ejection surface on the side opposite to the flow path member 30. The nozzles are open to the liquid ejection surface so that ink droplets in liquid form are ejected through the nozzles. Further, liquid flow paths which communicates with the nozzles and with flow paths of the flow path member 30, and a pressure generating unit that generates pressure variation of ink in the liquid flow path are disposed in the head body 40, which is not shown in the figure. The pressure generating unit may include, for example, those generating change in volume of the liquid flow path by deformation of the piezoelectric actuator having a piezoelectric material which has an electromechanical conversion function, thereby generating pressure variation of ink in the liquid flow path and ejecting ink droplets through the nozzles. The pressure generating unit may further include those using heat generating elements disposed in the liquid flow paths so that bubbles generated by heat from the heat generating elements causes ink droplets to be ejected through the nozzles. The pressure generating unit may further include a so-called electrostatic actuator that generates electrostatic force between a vibration plate and an electrode so that deformation of the vibration plate causes ink droplets to be ejected through the nozzles.

Accordingly, in the ink jet recording head 10, ink is supplied from the ink cartridge 20 to the head body 40 via the flow path member 30, and the pressure generating unit generates pressure variation of ink in the liquid flow path so that ink droplets are ejected through the nozzles.

As described above, by providing the buffer chamber 318 adjacent to the filter 317 of the liquid supply path 311, it is possible to prevent ink in the buffer chamber 318 and the air bubble discharge section 319 from thickening in a short period of time due to evaporation of water through filter 317 even if the ink cartridge 20 are removed. That is, by providing the buffer chamber 318, the volume of a space downstream of the filter 317 can be increased, and accordingly, despite evaporation of water through the filter 317, the increased amount of ink can delay the time when the ink turns into a gel or ink is deposited. Although the ability to discharge air bubbles in the region distant from the liquid supply path 311 downstream of the filter 317 is reduced by providing the buffer chamber 318, in this embodiment, the air bubble discharge section 319 is disposed between the filter 317 and the buffer chamber 318. Therefore, it is possible to prevent the ability to discharge air bubbles downstream of the filter 317 from being reduced, thereby preventing a problem such as dot missing.

Other Embodiments

Although one embodiment of the invention has been described above, the essential configuration of the invention is not limited thereto.

For example, in the above-mentioned first embodiment, the wall 319*a* which defines the air bubble discharge section 319 is disposed at a substantially constant distance from the filter 317 in a plane direction of the filter 317. However, the invention is not limited thereto and for example, the wall 319*a* may be formed to have a distance from the filter 317 gradually increasing toward the liquid supply path 311 that is open to the bottom of the buffer chamber 318. That is, the wall 319*a* may be inclined toward the opening of the liquid supply path 311. Further, the bottom of the buffer chamber 318 (the surface to which the liquid supply path 311 facing the filter 317 is open) may also be inclined toward the opening of the liquid supply path 311.

In the above-mentioned first embodiment, the seal member 330 is described as a hollow member that is composed of the first seal section 331, the second seal section 332 and the third seal section 333 and is open to one side. However, the invention is not limited thereto and for example, the seal member may be a solid member having any shape.

Figure 5:
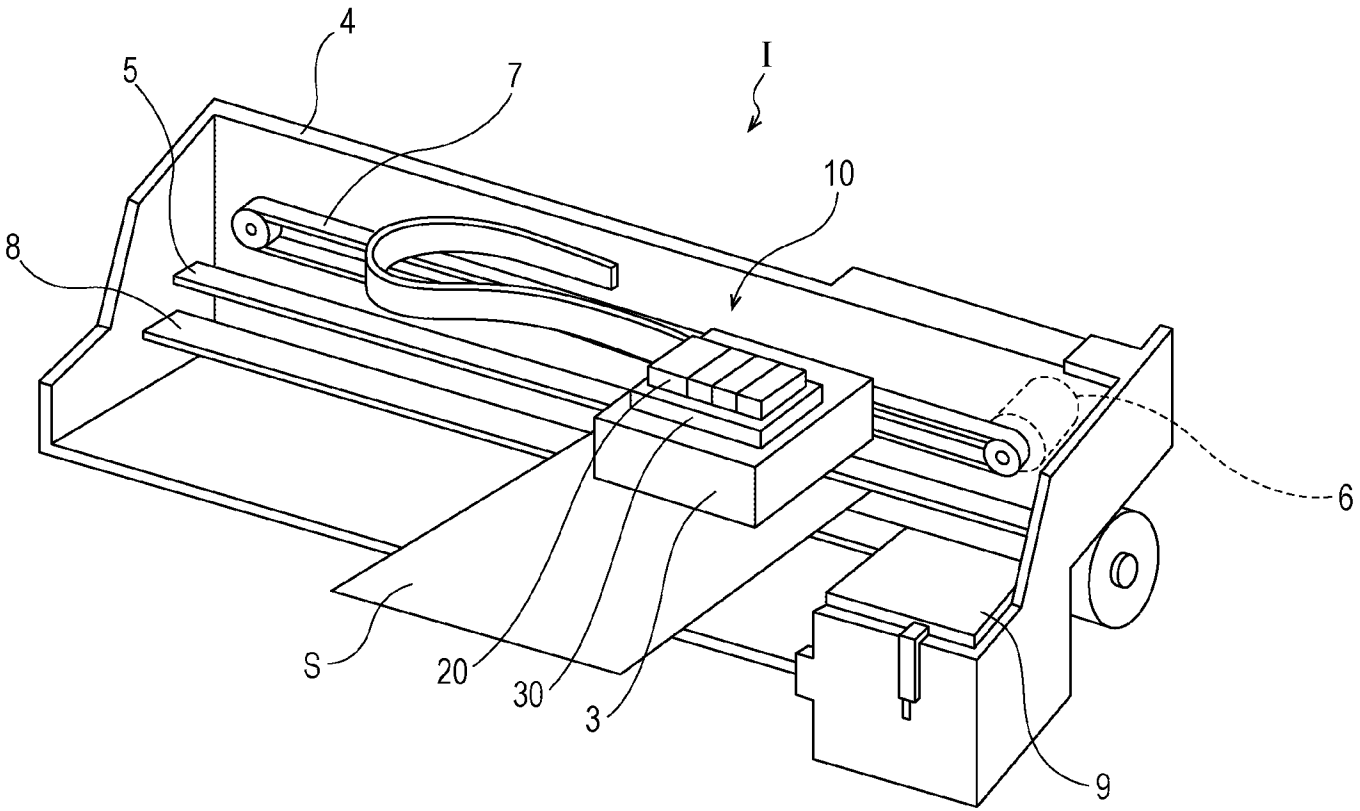
FIG. 5 is a schematic view of the recording apparatus according to one embodiment of the invention.

The ink jet recording head 10 according to the above-mentioned embodiment constitutes part of the ink jet recording head unit that includes an ink flow path which communicates with the ink cartridge and the like, and is mounted on an ink jet recording apparatus. FIG. 5 is a schematic view of an example of ink jet recording apparatus.

In the ink jet recording apparatus I shown in FIG. 5, a plurality of ink cartridges 20 that constitute an ink supply unit are detachably mounted on the ink jet recording head 10. A carriage 3 on which the ink jet recording head 10 is mounted is movable in the axial direction of a carriage shaft 5 which is disposed on the apparatus body 4. The ink jet recording head 10 is configured to eject, for example, black ink component and color ink component.

When a drive force from a drive motor 6 is transmitted to the carriage 3 via a plurality of gears which are not shown and a timing belt 7, the carriage 3 on which the ink jet recording head 10 is mounted moves along the carriage shaft 5. Further, a platen 8 is disposed along the carriage shaft 5 in the apparatus body 4 such that a recording sheet S which is a recording medium such as a sheet of paper fed by a sheet feeding roller which is not shown is wound on the platen 8 and transported.

In the above-mentioned first embodiment, the ink jet recording head 10 that includes the flow path member 30 is described. However, the invention may be applied to an ink jet recording apparatus that includes the flow path member 30 that is disposed at a position other than the ink jet recording head 10. Specifically, in an ink jet recording apparatus that includes an ink tank which is a liquid storing unit for storing ink and which is fixedly attached to the apparatus body 4 rather than being mounted on the carriage 3 and the ink tank and the head body 40 are connected via a tubular supply tube, the flow path member 30 may be provided, for example, at a position in which the ink tank is mounted.

In the above-mentioned ink jet recording apparatus I, the ink jet recording head 10 that is mounted on the carriage 3 and moves in a main scan direction is described as an example. However, the invention is not limited thereto and may be applied to, for example, a so-called line type recording apparatus in which the ink jet recording head 10 is provided at a fixed position and printing is performed by transporting the recording sheet S such as a sheet of paper in a sub-scan direction.

Moreover, the invention directs to a method for manufacturing liquid ejection heads in general and may be applied to, for example, a method for manufacturing recording heads such as various ink jet recording heads used for image recording apparatuses such as printers, color material ejection heads used for manufacturing color filters for liquid crystal displays and the like, electrode material ejection heads used for manufacturing electrodes for organic electroluminescence (EL) displays, field emission displays (FEDs) and the like, and bioorganic ejection heads used for manufacturing biochips.

The invention is not limited to the flow path member mounted on the liquid ejection head and the liquid ejection apparatus, and may be applied to any flow path member mounted to other devices.

The entire disclosure of Japanese Patent Application No. 2012-150821, filed Jul. 4, 2012 is incorporated by reference herein.

What is claimed is:

1. A flow path member comprising:

a flow path forming body that includes a liquid supply path through which liquid is supplied to a head body that ejects the liquid, and a mounting section to which one end of the liquid supply path is open and on which a liquid storing unit that supplies liquid to the liquid supply path is mounted;

a filter that is fixedly attached to the mounting section so as to cover an opening of the liquid supply path; and a seal member disposed on a circumference of the mounting section and made of an elastic material, wherein a buffer chamber formed in the flow path forming body is provided in the liquid supply path downstream of the filter, and an air bubble discharge section having a wall formed in the flow path forming body is provided in a region at least distant from the opening of the liquid supply path downstream of the buffer chamber in a plane direction of the filter such that the wall is closer to the filter than to the buffer chamber and has a width in the plane direction of the filter which is larger than that of the buffer chamber.

2. The flow path member according to claim 1, wherein the air bubble discharge section is continuously formed in the circumferential direction of the buffer chamber.

3. The flow path member according to claim 1, wherein the wall that defines the air bubble discharge section is disposed at a constant distance from the filter in a direction perpendicular to the plane direction of the filter.

4. A liquid ejection head comprising the flow path member according to claim 1 and a head body.

5. A liquid ejection head comprising the flow path member according to claim 2 and a head body.

6. A liquid ejection head comprising the flow path member according to claim 3 and a head body.

7. A liquid ejection apparatus comprising the liquid ejection head according to claim 4.

8. A liquid ejection apparatus comprising the liquid ejection head according to claim 5.

9. A liquid ejection apparatus comprising the liquid ejection head according to claim 6.

10. A liquid storing unit mounted on the mounting section of the flow path member according to claim 1.

11. A liquid storing unit mounted on the mounting section of the flow path member according to claim 2.

12. A liquid storing unit mounted on the mounting section of the flow path member according to claim 3.

13. The flow path member according to claim 1, wherein the air bubble discharge section is positioned immediately downstream from the filter.

* * * * *